United States Patent [19]

Kallinke et al.

[11] 4,362,402

[45] Dec. 7, 1982

[54] CLOCK WITH A HOLDER

[75] Inventors: Manfred Kallinke, Hofheim-Wallau; Walter Bleuel, Hofheim; Wolfgang Hoehn, Liederbach; Kurt Heinrich, Usingen, all of Fed. Rep. of Germany

[73] Assignee: VDO Adolf Schindling AG, Frankfurt am Main, Fed. Rep. of Germany

[21] Appl. No.: 167,886

[22] Filed: Jul. 14, 1980

[30] Foreign Application Priority Data

Jul. 20, 1979 [DE] Fed. Rep. of Germany ..... 2929373

[51] Int. Cl.[3] ..... G04B 37/00; A47F 7/00

[52] U.S. Cl. ..... 368/317; 248/116

[58] Field of Search ..... 368/88, 276, 277, 278, 368/316, 317; 224/185, 903; D10/21, 23, 26; 248/114–116, 442, 23.9

[56] References Cited

U.S. PATENT DOCUMENTS

| | | | |
|---|---|---|---|
| 1,789,602 | 1/1931 | Siptrott | 368/316 |
| 2,551,405 | 5/1951 | Winterbourne | 368/316 |
| 2,559,480 | 3/1951 | Jaegstroem | 368/316 |
| 3,062,491 | 11/1962 | Green | 368/316 X |
| 3,191,901 | 6/1965 | Green | 368/316 X |
| 3,312,435 | 4/1967 | Malone | 224/903 X |
| 4,075,829 | 2/1978 | Geff | 368/316 X |

*Primary Examiner*—Vit W. Miska

*Attorney, Agent, or Firm*—Martin A. Farber

[57] ABSTRACT

A clock with a housing with quadratic or square cross-section in the plane of the dial plate and a holder for the detachable reception of the housing. At least one part of the holder is formed in the shape of a yoke having two spring arms between which the housing can be clampingly inserted, and at least the side surfaces of the housing and at least the free ends of the arms are provided with interengaging profiles for the detent connection of the holder and the housing.

13 Claims, 3 Drawing Figures

CLOCK WITH A HOLDER

The invention relates to a clock with a housing with quadratic or square cross-section in the plane of the dial plate and a holder for the detachable reception of the housing.

A clock of this type is already known (German GM No. 74 39 428), in which the rearward part of the housing is formed like a ball and rests in a holder with a calotte-shaped receptor. The holder and the clock housing are connected with one another by means of a screw which passes through an elongated slot which is present in the receptor and ends in a corresponding threaded bore in the housing. After releasing the screw the clock can be swung in the holder in a plane by about 45 angular degrees and can be fixed by tightening the screw in the respective position at the time. Such a clock has the disadvantage that a change in the position of the housing in the holder is not possible without the help of a tool, namely a screwdriver. Moreover the position change of the housing in the holder is limited to the course or shape of the elongated slot, and consequently to a single plane of movement.

With another known clock (German OS No. 25 31 747), the clock is seated in a holder which comprises two parts which are swingable relative to each other about a common axis. In the case of this known clock the holder also assumes the function of a housing. In such a clock, the inclination of the dial to the surface on which it rests can be changed and furthermore the clock, after removal of a viewing pane or glass, can be adapted to be turned through 90° in the holder-housing unit of the dial plane, whereby the overall aesthetic impression given by the clock can be changed. To be sure, this clock permits a greater change in the position of the dial with respect to the surface on which the clock is placed, but this change in position is still very limited. Furthermore, for given changes in position of the dial with respect to the housing the clock must be partly taken apart and then assembled again, which is a rather cumbersome procedure.

It is an object of the present invention to avoid these disadvantages.

It is thus an object of the invention to create a clock with a holder, with which the holder and the clock can be brought into the most different relative positions with respect to one another such that the clock can be brought into an easily readable position of use in any just conceivable position of the holder. Moreover the measures which are required for the realization of this object should be as inexpensive as possible and lead to a simple, construction of the holder and of the clock which are advantageous in production.

In accordance with the invention at least one part of the holder (7) is formed in the shape of a yoke (9) having two resilient or spring arms (14, 15) between which the housing (2) can be clampingly inserted, and at least the side surfaces of the housing (2) and at least the free ends (16, 17) of the arms (14, 15) are provided with interengaging profiles (3, 18) for the catch or detent connection of the holder (7) and the housing (2).

By the provision of the profiles both on the housing and on the arms of the yoke these two members can be brought into the most different relative positions with respect to each other. Thus, in view of the square cross-section of the clock housing it is possible to turn the clock housing in 90° steps with respect to the yoke in the plane of the dial, to arrange the clock housing in different position of inclination with respect to the surface on which it is placed or, with the same position of inclination to such surface, to arrange it in different swing positions in the yoke. Depending on the yoke shape which is selected —a U-shaped, V-shape, Y-shape, S-shape, etc. —further possibilities are obtained for the positioning of the housing with respect to a surface upon which it is placed or with respect to a given position of the holder. One particular advantage of the invention is that the elements necessary to carry out the invention can be produced without special manufacturing expense.

In accordance with one advantageous embodiment of the invention, at least the side surfaces of the housing (2) and at least the free ends (16, 17) of the arms (14, 15) of the yoke are each provided with longitudinally and transversely extending ribs. Such a profiling can be effected particularly simply from a manufacturing standpoint.

In accordance with another advantageous embodiment, the profiles (3, 18) are of calotte or hemispherical shape. The use of calotte or hemispherical profiles has an advantage over profiling by means of longitudinally and transversely extending ribs in that particularly large numbers of different relative positions between the housing and the holder or yoke, respectively, can be established.

It has been found particularly suitable to provide at least the side surfaces of the housing (2) with calotte or hemispherical depressions (3) and to provide at least the free ends (16, 17) of the arms (14, 15) with calotte or hemispherical elevations (18). To be sure, the side surfaces of the housing in principle could also be provided with calotte or hemispherical elevations and the free ends of the arms with hemispherical depressions, but a better holding of the clock housing is obtained in the former case, which is of particular importance when the clock is to be used entirely without a holder, which in principle is also possible.

Furthermore, a more favorable overall aesthetic impression is obtained if the housing is provided with calotte shaped or hemispherical depressions. For the same reason it is advantageous to provide the back wall of the housing (2) as well as the side surfaces with profiles (3).

In accordance with a further concept of the invention, at least one elevation (4, 5) arranged in the region of the front edge, for instance a calotte or hemispherical elevation, is provided at least on the lower side surface of the housing (2), said elevation engaging into a corresponding recess (19), for instance a hole, in the yoke (9). The height of the elevation in this connection is selected larger than that of a hemispherical elevation or of the longitudinally and transversely extending ribs so that if the clock is to be used without a holder and placed on a supporting surface an oblique position of the housing is obtained as a result of this elevation and in this way the time shown by the clock can be read more easily. In order to obtain good stability it is advisable to provide two elevations (4, 5), arranged respectively one in each of the front corner regions of a side surface of the housing, and to provide the yoke (9) with at least two corresponding recesses (19, 20) and preferably with two recesses in each arm.

Particularly for aesthetic reasons it has been found advisable to form the yoke (9) in V-shape with arm ends (16, 17) parallel to each other. In principle other yoke shapes are also possible, as already stated above, but a V-shaped yoke, in addition to making a more favorable overall impression, has the advantage that a particularly large number of relative positions of the yoke and housing can be obtained therewith. In order to assure a vibration-free reception of the housing in the yoke it is advisable to make the width of the arm ends (16, 17) which are parallel to each other approximately equal to the depth of the housing (2). For the same reasons it is advisable to form one arm surface (14) of the yoke (9) as a resting surface.

In accordance with another concept of the invention, a part of the holder (7) is formed in the shape of a clamp (8) with two clamping jaws (22, 23) which are movable relative to each other, the yoke (9) being seated on the clamp. By such a measure the usefulness of the clock can be considerably further increased since in the case of a holder with a clamp the possibility exists of being able to use the clock not only in conjunction with flat supporting surfaces but also in conjunction with corners, frames, bars, posts and other objects to which the holder and thus the clock can be clamped. When using the clamp merely with the yoke, in order not to disturb the aesthetic appearance of this combination by the presence of a clamp, it is advisable to connect the yoke (9) and the clamp (8) detachable with respect to each other so that the clock can be used, as desired, merely with the yoke or with the yoke-clamp combination.

In accordance with one advantageous embodiment, the clamp has two resilient clamping jaws which extend substantially axially parallel to each other. Such an embodiment is particularly simple and economical from the standpoint of manufacture. It has a certain disadvantage that the scope of use of the clamp is limited to object within a given range of thickness in view of the relatively small spreadability of the two clamping jaws. This disadvantage is not present in another advantageous embodiment in which the clamp (8) has two spring-biased clamping jaws (22, 23) which are pivotable around a common axis (21), and each of the clamping jaws forms at one end a handle (24). This embodiment, to be sure, has a construction which is somewhat more unfavorable from the standpoint of manufacture than the embodiment previously described since it comprises three individual parts which are to be assembled to each other.

With the above and other objects and advantages in view, the present invention will become more clearly understood in connection with the detailed description of a preferred embodiment, when considered with the accompanying drawings, of which:

Figure 1:
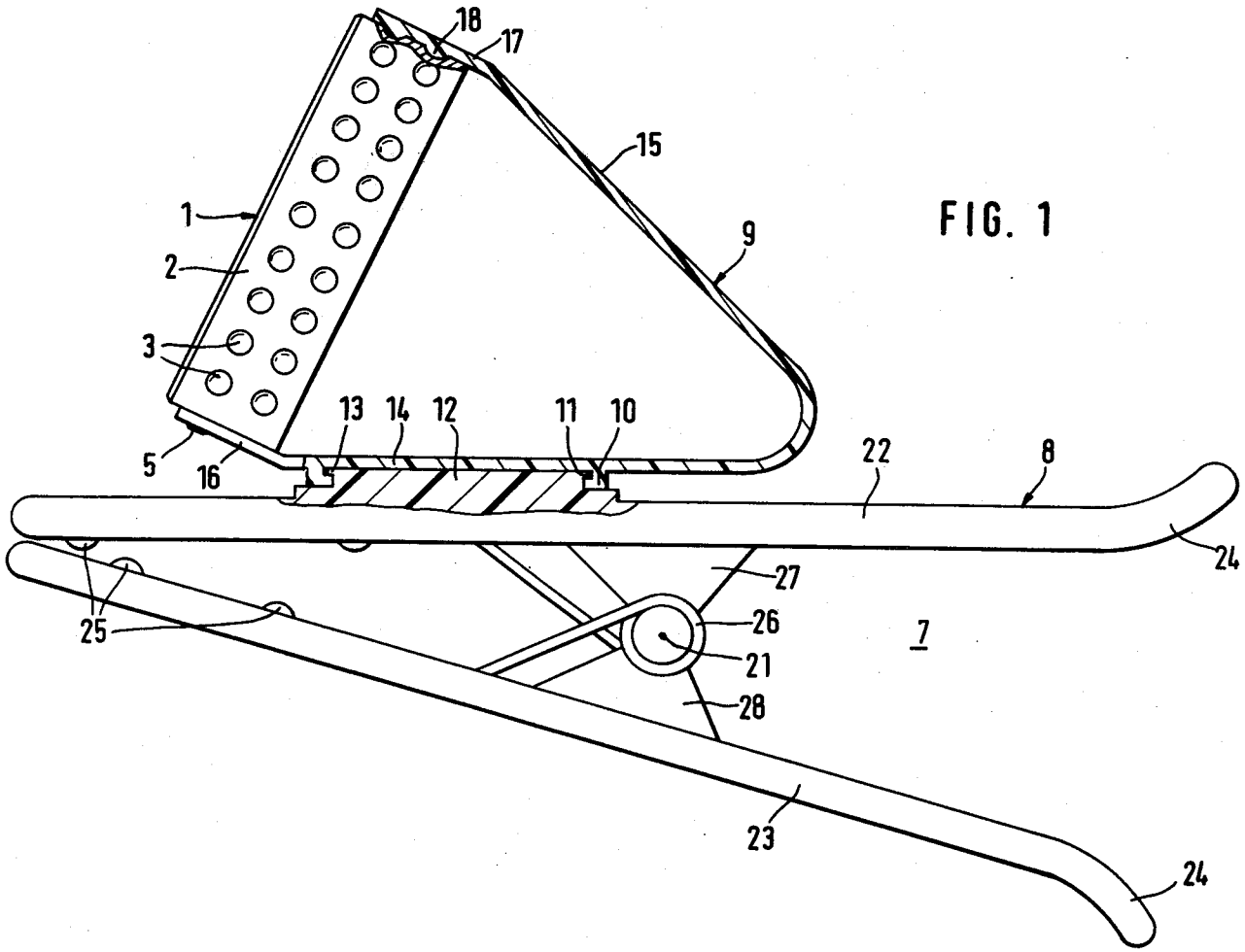
FIG. 1 is a side view of a clock having a holder comprising a yoke and a clamp.
Figure 2:
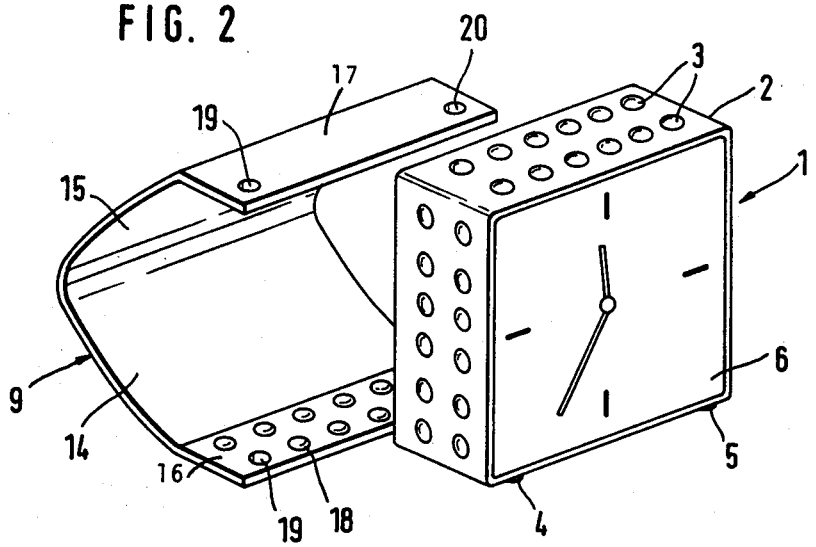
FIG. 2 is a perspective view of the clock with the yoke detached from it.
Figure 3:
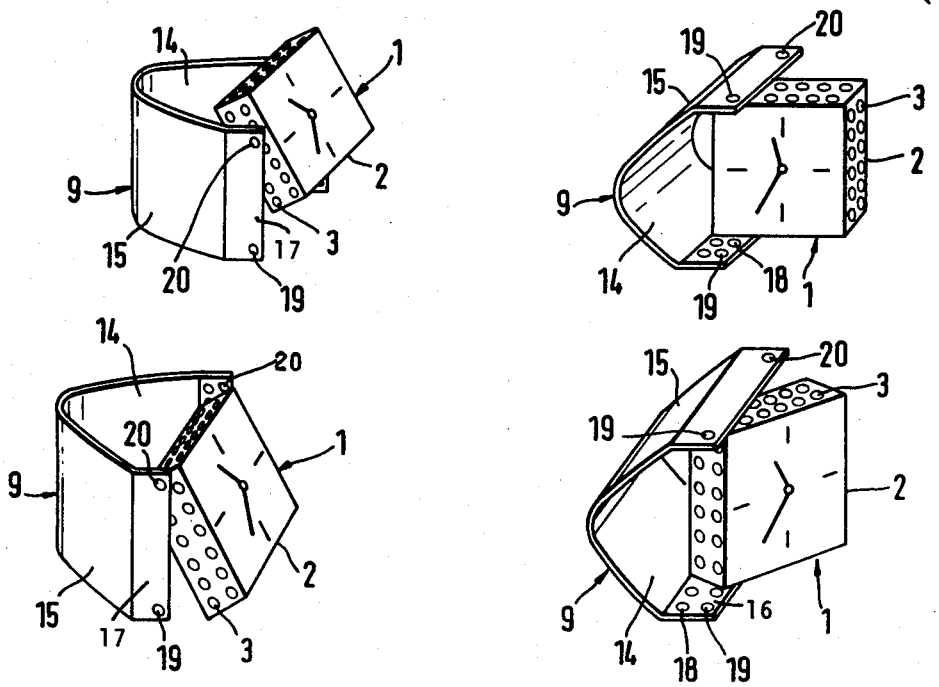
FIG. 3 are perspective views of various relative positions of the yoke and clock.

The clock 1 comprises a housing 2 in which the time-keeping and time-indicating means of the clock are arranged and which is closed by a viewing glass in the region of the time-indicating means. The housing 2 is of square cross-section in the plane of the dial and is provided on its side surfaces as well as on the rear side (not visible) with hemispherical depressions 3 which are arranged in two parallel rows on the side parts. On the bottom side surface of the housing 2, in the region of the front corners, instead of the depressions, two elevations 4 and 5 are provided so that the clock, when placed on a flat surface, has its dial plate 6 facing slightly upward.

The housing 2 of the clock 1 is seated in a holder or mount 7 which comprises a clamp 8 and a yoke 9. The clamp 8 and the yoke 9 are detachably connected to each other. For this purpose a projecting circular ring 10 with an undercut 11 is formed on the yoke 9, which ring is made of plastic. The ring is adapted to be placed rotatably for detent engagement over a complementary circular projection 12 having a protruding edge 13.

Each of the two arms 14 and 15 of the V-shaped yoke 9 is bent at its free end in such a manner as to form two end pieces 16 and 17 of the arms, respectively. The end pieces 16 and 17 are parallel to each other. The housing 2 can be inserted and clamped between these end pieces 16 and 17. The two end pieces 16 and 17 of the arms are provided, on the sides thereof adjacent the housing 2, with calotte-shaped or hemispherical elevations 18 which engage into the corresponding calotte-shaped hemispherical depressions 3 in the side walls of the housing 2. Two holes 19 and 20 are provided through each of the two end pieces 16 and 17 of the arms through which there project the elevations 4 and 5 which are formed on the housing 2.

As can be noted in particular from FIG. 1, the width of the parallel end pieces 16 and 17 is selected approximately equal to the depth of the housing 2 of the clock 1.

The clamp 8 comprises two clamping jaws 22 and 23 which are rotatable about a common axis 21. The clamping jaws each form handles 24 at one end thereof. At their ends facing away from the handle 24 both of the clamping jaws 22 and 23 are provided with rubber pads 25. By these rubber pads 25 there is obtained a better or securer holding of the clamp onto an object.

The two clamping jaws 22 and 23 are pretensioned by means of a coil spring 26, the ends of which are fastened to the two clamping jaws 22 and 23, such that the parts of the clamping jaws 22 and 23 which carry the pads 25 pressingly abut against each other. The two clamping jaws 22 and 23 rest against the coil spring 26 by means of extensions or shoulders 27 and 28 formed on the jaws 22 and 23, respectively. Such a construction has the advantage that an additional shaft is not required for connecting the two clamping jaws 22 and 23 together.

While we have disclosed embodiments of the invention it is to be understood that these embodiments are given by example only and not in a limiting sense.

We claim:

1. A clock with a holder comprising a clock having a housing and a dial plate mounted therein, said housing being square in cross-section in the plane of the dial plate, holder means for detachably holding said housing, at least one part of said holder means is formed in the shape of a yoke having two resilient arms, said housing is clampingly insertable between said arms, at least side surfaces of said housing and at least free ends of said arms being formed with interlocking profile means for a snap-in connection of said housing and said holder means, said profile means are calotte-shaped, and said profile means comprise calotte-shaped depressions in at least said side surfaces of said housing and calotte-shaped elevations in at least said free ends of said arms, said yoke is formed in a V-shape with the ends of said arms parallel to each other, the width of the ends of said arms is approximately equal to the depth of said housing, a part of said holder means is formed in the shape of a clamp with two clamping jaws which are movable relative to each other, said yoke is seated on said clamp.

2. The clock as set forth in claim 1, wherein said housing is formed with at least one housing elevation arranged in a region of a front edge of said housing at least on a bottom side surface of said housing, said yoke is formed with a recess corresponding to said housing elevation, said elevation engages into said recess.

3. The clock as set forth in claim 5, wherein two of said housing elevations are arranged respectively one in each of front corner regions of said housing, and said yoke has two of said recesses arranged corresponding to said two housing elevations.

4. The clock as set forth in claim 1, wherein said side surfaces and a rear wall of said housing have said profile means thereon.

5. The clock as set forth in claim 1, wherein one surface of at least one of said arms of said yoke is formed as a standing surface.

6. The clock as set forth in claim 1, wherein said yoke and said clamp are detachably connected to each other.

7. The clock as set forth in claim 1 or 6, wherein said clamping jaws are resilient and extend substantially axially parallel to each other.

8. The clock as set forth in claim 1 or 6, wherein said clamping jaws constitute two spring-biased clamping jaws which are pivotably mounted around a common axis, each of said clamping jaws forms a handle at one end thereof.

9. The clock and holder as set forth in claim 6, wherein said yoke and said clamp are rotatably mounted with respect to each other.

10. The clock and holder as set forth in claim 8, wherein said clamping jaws have shoulders facing each other and forming facing peripheral portions of a cylindrical surface, a coil spring having a coil and ends extending therefrom is disposed with the coil in said peripheral portions and engages with said ends against said clamping jaws, respectively.

11. A clock with a holder, comprising a clock having a housing and a dial plate mounted therein, a substantially V-shaped holder part having spring arms biased against said housing at opposite sides of the latter, said housing and said holder part define engaging surfaces, said surfaces having a predetermined surface format with a repeating design of depressions and elevations, respectively, for mating engagement, said repeating design constituting means for permitting numerous positions of engagement of said housing with said holder part.

12. The clock and holder according to claim 11, further comprising clamp means for attachment to an object and releasably rotatably attached to said holder part at a location removed from said housing whereby said holder part can be attached to the object while retaining freedom of orientation of said housing within said holder part.

13. The clock and holder according to claim 11 or 12, wherein the depressions are of calotte-shape.

* * * * *